US007464889B2

(12) United States Patent
Westerman et al.

(10) Patent No.: US 7,464,889 B2
(45) **Date of Patent: *Dec. 16, 2008**

(54) MOBILE ROCK CRUSHING PLANT

(75) Inventors: Mark Westerman, Eugene, OR (US); James Donald Brock, Chattanooga, TN (US); Gary Heeszel, Eugene, OR (US); Lawrence Olsen, Springfield, OR (US); Robert Carnes, Eugene, OR (US)

(73) Assignee: Johnson Crushers International, Eugene, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/563,644

(22) Filed: Nov. 27, 2006

(65) Prior Publication Data

US 2007/0158479 A1 Jul. 12, 2007

Related U.S. Application Data

(63) Continuation-in-part of application No. 11/122,959, filed on May 4, 2005, now Pat. No. 7,143,968, which is a continuation of application No. 10/165,677, filed on Jun. 6, 2002, now Pat. No. 6,935,587.

(51) Int. Cl.
*B02C 25/00* (2006.01)

(52) U.S. Cl. ..... 241/101.76; 241/36

(58) Field of Classification Search ..... 241/33–37, 241/30, 101.76

See application file for complete search history.

(56) References Cited

U.S. PATENT DOCUMENTS

| | | | | |
|---|---|---|---|---|
| 3,510,073 | A | 5/1970 | Mailliard | |
| 3,647,150 | A * | 3/1972 | Stephanek | 241/75 |
| 4,383,651 | A | 5/1983 | Couperus | |
| 4,524,916 | A | 6/1985 | Keyes et al. | |
| 5,025,992 | A | 6/1991 | Niebur | |
| 5,161,744 | A | 11/1992 | Schoop et al. | |
| 5,251,832 | A | 10/1993 | Hentschel | |
| 5,285,973 | A * | 2/1994 | Goforth et al. | 241/36 |
| 5,294,065 | A | 3/1994 | Harms et al. | |
| 5,664,907 | A | 9/1997 | Betsinger | |
| 5,716,014 | A * | 2/1998 | Tamura et al. | 241/36 |
| 6,032,886 | A | 3/2000 | Drinkwater et al. | |
| 6,386,375 | B1 | 5/2002 | Olsen | |
| 6,575,303 | B1 | 6/2003 | Brock et al. | |
| 6,581,780 | B1 | 6/2003 | Jakob et al. | |
| 6,752,165 | B2 * | 6/2004 | Johansson | 137/4 |
| 6,889,846 | B2 | 5/2005 | Olsen | |
| 6,935,587 | B2 | 8/2005 | Brock et al. | |
| 6,953,121 | B2 | 10/2005 | Olsen | |
| 2003/0136865 | A1 * | 7/2003 | Karra | 241/33 |
| 2003/0226919 | A1 | 12/2003 | Brock et al. | |

FOREIGN PATENT DOCUMENTS

WO WO 2004/096677 A1 11/2004

* cited by examiner

*Primary Examiner*—Mark Rosenbaum
(74) *Attorney, Agent, or Firm*—Schwabe, Williamson & Wyatt, P.C.

(57) ABSTRACT

A method and apparatus for wirelessly monitoring and/or controlling the processing operations of a mobile rock crushing plant.

4 Claims, 8 Drawing Sheets

MOBILE ROCK CRUSHING PLANT

RELATED APPLICATIONS

This application is a continuation in part to patent application Ser. No. 11/122,959, filed on May 4, 2005, which is a continuation of patent application Ser. No. 10/165,677, filed on Jun. 6, 2002.

FIELD OF THE INVENTION

Embodiments of the present invention relates to a aggregate processing plants plant including numerous machines that cooperatively operate to crush, screen and convey aggregate materials, and more particularly it relates to a plant having a wireless control for monitoring and/or controlling the cooperative processing, and which allows for efficient set up, break down and transportation of the machines for rendering the plant viably transportable as between different locations

BACKGROUND

Crushed rock has played and continues to play an integral role in road building and road maintenance. Traditionally, rock is extracted from rock quarries, located on selected property sites and transported to a nearby fixed-base rock crushing plant. Current rock crushing plants typically consist of multiple rock crushers that reduce oversized rock down to a desired size, multiple screens that separate the crushed rock according to size and multiple conveyors that transport the sorted material between the rock crushers and screens and then onto size designated stockpiles. Transfer of rock from the screens to the stockpiles can also be accomplished through the use of front end loaders, dump trucks and the like.

Prior art rock crushing facilities are typically set up near the rock extraction location such that great time, energy and manpower is required to properly position, secure and interconnect the plant components. The rock crushed by these plants is stockpiled and used to serve the needs of a regional area. Since crushed rock is hauled from the fixed base rock crushing plant to the point of use, the service area is limited to a certain radius by economics and efficiency reasons. As a result, multiple rock quarries and rock crushing plants are selectively spaced apart so as to enable the plants to supply crushed rock to distinct regional areas.

This practice requires equipping and manning multiple fixed rock crushing plants, which in itself is expensive and inefficient, but previously considered unavoidable. A single plant typically requires, e.g., three rock crushers, two screens, about a half dozen feed conveyors and similar number of stockpile conveyors. This equipment has to be organized into a desired pattern or arrangement to enable the rock materials to be sequenced through the equipment for processing. Given the number of processing stages, breaking down the entire operation presents an ominous task to an operator desiring to move the operation between job sites. To break down, move and bring back on line the current operating systems can take a number of days and many man-hours, the cost can be prohibitive and is considered viable only when moving from one permanent job site to another permanent job site.

Factors affecting the immobility of these crushing plants include the need to disassemble the various processing stages and to rearrange the equipment into small enough components such that when loaded onto trailers, they meet height, weight, width and length road restrictions. Any connection between the major processing components (e.g. feed conveyors and the like) need to be decoupled and moved separately. Further, the components may often be coupled together through hard wired systems, both for communications and/or power generation. Such hard wire coupling not only creates a significant operation and safety hazard on the job site, but also impedes the efficiency of the breakdown and set up of a plant.

Nevertheless, embodiments of the present invention resolves the inefficiencies and exorbitant costs associated with the current practice by converting a fully operable, permanently sited rock crushing plant as generally described above into a mobile rock crushing plant

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following description, reference is made to the accompanying drawings which form a part hereof wherein like numerals designate like parts throughout, and in which is shown by way of illustration of various embodiments of the invention. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Figure 1:
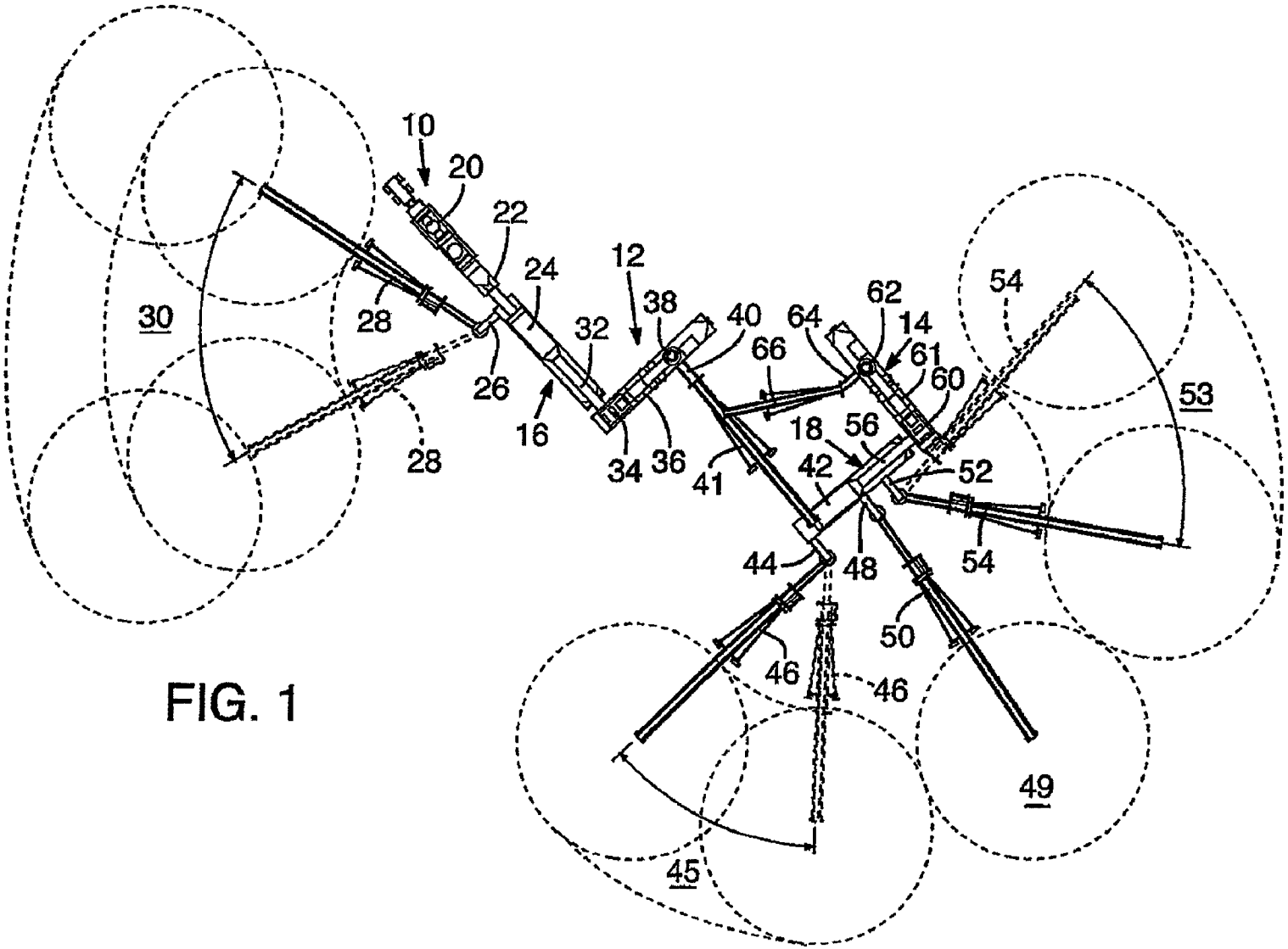
FIG. 1 is a top view of a standard layout for a mobile rock crushing plant in accordance with the preferred embodiment of the present invention, depicting the mobile rock crushers, mobile screen units and material distribution conveyors in accordance with embodiments of the present invention.

FIG. 1 is an overhead view of a mobile rock crushing plant that encompasses one arrangement of the major rock crushing components and conveyors. The illustrated embodiment of the mobile rock crushing plant consists of five individual mobile components including 1) a mobile jaw crushing unit 10 that reduces unprocessed larger rocks to rocks into a desired size range; 2) two mobile cone crushing units 12 and 14 that further reduces the rocks to various smaller sizes, usually to a size of approximately three-quarters of an inch or less; and 3) two mobile screen units 16 and 18 that separate the crushed rock based on size. One skilled in the art would appreciate that the arrangement of the illustrated embodiment is one of many configurations for a mobile rock crushing plant, and that fewer or more screen units or crushing units could be employed.

From the beginning of the process of the illustrated embodiment, rock of varying sizes is extracted from a quarry and transported to the mobile jaw crushing unit 10. A jaw crusher 20 of the mobile jaw crushing plant 10 crushes the mined rock into sizes less than a certain size and deposits the rock onto an outfeed conveyor 22. In the preferred embodiment of the invention, the jaw crusher 20 reduces the mined material to less than 6 inches in size. The outfeed conveyor 22, which is an integrated piece of the mobile jaw crushing plant 10, moves the crushed rock from the jaw crusher 20 to the first mobile screen unit 16.

The first mobile screen unit 16 contains a multi tiered screen 24 that separates the rock fed from the jaw crusher trailer based on size. The multi tiered screen 24 segregates rock of less than a certain diameter, also referred to as "fines" (e.g. less than one half of an inch in diameter) and deposits the fines onto dual interim conveyors located below the multi tiered screen 24, which moves the screened material to the cross conveyor 26. These conveyors can be reversible such that they can move material collected from the screen towards either the front or the rear of the mobile screening unit. The cross conveyor 26 extends laterally outward during operation or generally perpendicular to the side of the mobile screen unit 16. The cross conveyor 26 moves the screened rock to a detached telescoping stockpile conveyor 28 that deposits the fines into storage pile 30. The remaining larger rock not screened as fines is deposited onto the screen outfeed conveyor 32 and conveyed to the primary cone crushing unit 12. The multi tiered screen 24, dual reversible interim conveyors, cross conveyor 26 and screen outfeed conveyor 32 are integrated components of the overall mobile screen unit 16.

The secondary crushing unit 12, or cone crushing unit as show in the illustrated embodiment, receives the separated rock from the first screen outfeed conveyor 32 in a surge bin 34. The surge bin 34 variably controls the amount of feed material that is fed to the cone crusher 38 through the use of a vibrating feeder. To assure that the cone crusher does not run out of material, sonic detectors may be utilized to detect impending depletion levels of material (rock) in the crusher with the feed conveyor made responsive to the detectors to thereby initiate a speed up of the material feed. The surge bin accordingly deposits a steady stream of rock onto the cone crusher feed conveyor 36, which transports the rock to the top of the cone crusher 38 in sufficient quantity to avoid depletion. The cone crusher 38 crushes the rocks to a maximum size range, which in the one embodiment is approximately one inch to and inch and one-half in diameter. The crushed rock exits the bottom of the cone crusher 38 and is deposited onto the cone crusher cross conveyor 40. The cone crusher cross conveyor 40 deposits the crushed rock onto a first transport conveyor 41, which transports the crushed rock to the second mobile screen unit 18. The surge bin 34, cone crusher feed conveyor 36, cone crusher 38, and the cone crusher cross conveyor 40 are all integrated components of the mobile crushing unit 12.

The second mobile screen unit 18, like the first, also contains a multi tiered screen 42 that separates the crushed rock by size. In the illustrated embodiment, the second mobile screen unit 18 is set up to separate the crushed rock into four different sizes: <¼"; ¼"-⅜"; ⅜"-⅝"; and >⅝". As one skilled in the art would recognize, the size of the screened rock can be controlled by using different diameter screens in the decks of the multi tiered screen 42. From the multi-tiered screen 42, the <¼" sized rock is deposited on a reversible interim conveyor (shown and discussed with regard to FIGS. 2, 2A, and 3 below) located below and running substantially the length of the multi-tiered screen 42, and transported to the ¼" cross conveyor 44, which extends laterally outward or generally perpendicular to the mobile screen unit 18 during operation. The ¼" cross conveyor 44 transports and deposits the material on to a second telescoping stockpile conveyor 46 that stockpiles the material at 45. The ¼"-⅜" sized rock is deposited from the end of the screen 42 directly onto the ⅜" cross conveyor 48, which transports and deposits the material on a fourth telescoping stockpile conveyor 50 that stockpiles the material at 49. The even larger ⅜"-⅝" sized rock is deposited onto another reversible interim conveyor (shown and discussed with regard to FIGS. 2, 2A, and 3 below) that conveys the rock forward to the ⅝" cross conveyor 52. The ⅝" cross conveyor transports and deposits the separated material on a fifth telescoping stockpile conveyor 54 that stockpiles the material at 53. Any material larger than ⅝" (unscreened material) moves from the multi-tiered screen 42 to a second screen outfeed conveyor 56. The second screen outfeed conveyor 56 transports the rock to the surge bin 60 of a tertiary mobile crushing unit 14, which in the illustrated embodiment is also a cone crushing unit. In the preferred embodiment, as with the first mobile screen unit 16, the multi tiered screen 42, dual reversible interim conveyors, cross conveyors 44, 48 and 52, and the secondary screen outfeed conveyor 56 are integrated components of the overall mobile screen unit 18.

The tertiary mobile crushing unit 14, also a cone crusher in the illustrated embodiment, is substantially the same as the secondary crushing unit 12. The feed from the mobile screen unit outfeed conveyor 56 is received in surge bin 60, controllably deposited onto the cone crusher feed conveyor 61, which in turn feeds the cone crusher 62 where the rock is again crushed. The crushed rock exits the bottom of the tertiary crusher 62 and is deposited on a second cone crusher cross conveyor 64. The second cone crusher cross conveyor 64 transports and deposits the material on a second transport conveyor 66, which redeposits the material on the first transport conveyor 41. From here the crushed rock is rescreened in the second mobile screen unit 18. In the illustrated embodiment, as with the secondary crushing unit 12, the surge bin 60, cone crusher feed conveyor 61, cone crusher 62, and the cone crusher cross conveyor 64 are integrated components of the mobile crushing unit 14.

Figure 2:
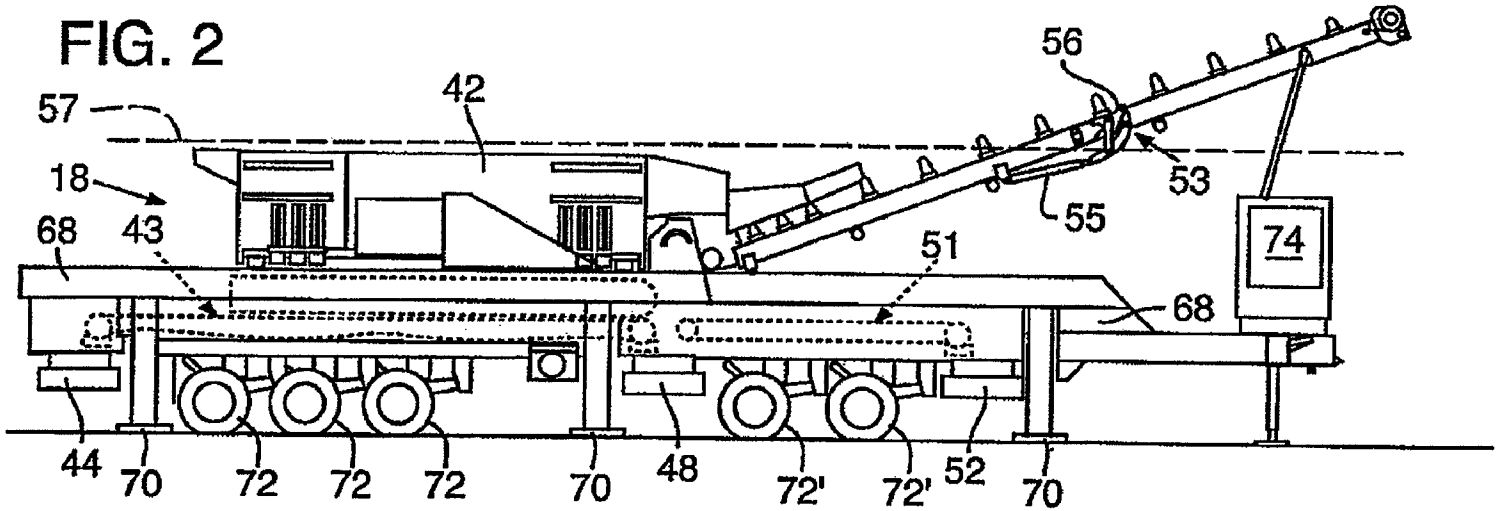
FIG. 2 is a side view of a mobile screen unit in its operational configuration in accordance with embodiments of the present invention.

FIG. 2 shows an expanded side view of the independent and fully mobile screen unit 18 in its operational configuration. It is understood that mobile screen unit 16 is substantially the same as mobile screen unit 18, except mobile screen unit 16 has fewer cross conveyors and reversible interim conveyors. In describing components that enable mobility of the mobile screen unit 18, the same description applies to mobile screen unit 16.

Figure 2A:
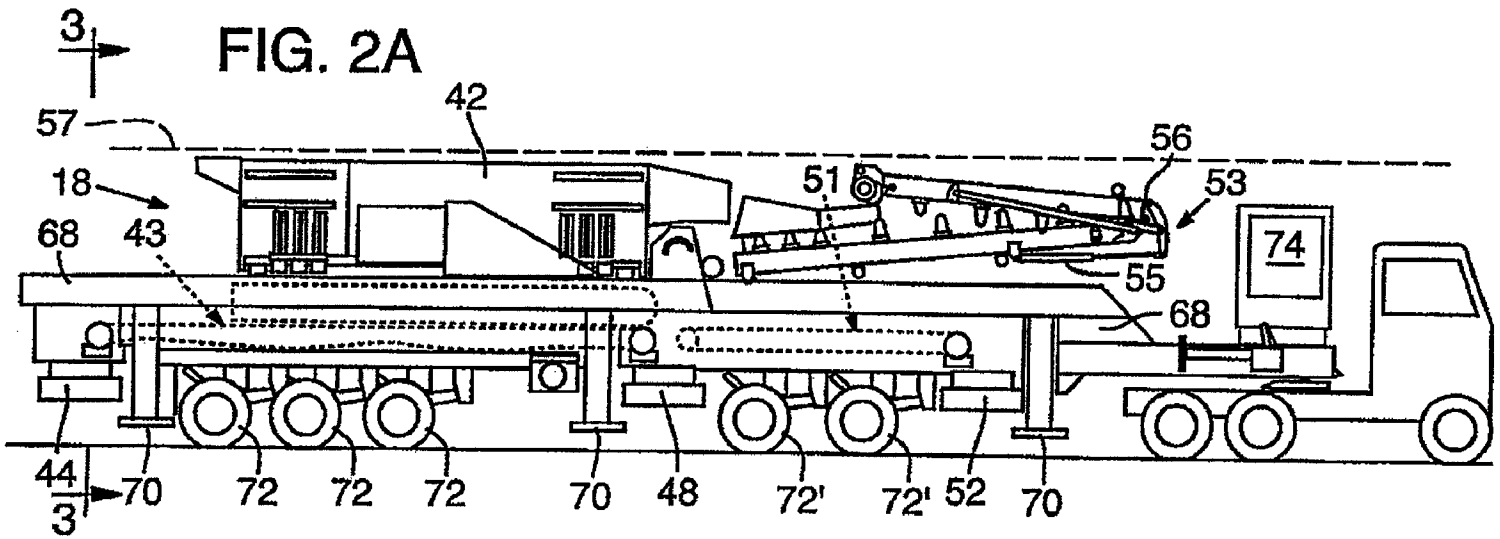
FIG. 2A is a side view of the mobile screen unit of FIG. 2 in its travel configuration in accordance with embodiments of the present invention.

Mobility of the screen units is achieved by keeping the height, weight, length and width of the trailer within the state and federally imposed road restrictions. The multi-tiered screen 42 is mounted on a screen transport trailer 68. The screen transport trailer is fit with multiple downward extending jacks 70 that stabilize and level the trailer when it is moved into the position determined by the site plan. The jacks 70 are independent and can be selectively extended to account for varying terrain. As shown in FIG. 2A, to allow the mobile screen unit to move from its pre-determined location to another selected location, the stabilizing jacks 70 are retracted to the point that the weight of the screen transport trailer 68 and other components of the mobile screen unit is no longer distributed on the stabilizing jacks 70.

As shown in FIGS. 2 and 2A, the screen transport trailer 68 employs multiple axle and wheel combinations 72 and 72' that distribute the mobile screen unit's immense weight when it is in the mobile configuration and is transported on the roads. In the illustrated embodiment, the forward axle and wheel combinations 72' are steerable to allow the trailer to meet certain road length restrictions. The steerable axle and wheel combinations 72' also allow the mobile screen unit to be readily maneuvered into place. However, one skilled in the art would appreciate that the axles 72' do not have to be steerable, as the size and length of the trailer in its overall configuration dictates whether the axles need to be steerable. To further enhance the mobile screen unit's mobility, a power generation unit 74 is fixed on the screen transport trailer 68. The power generation unit 74 supplies the necessary power to operate the multi tiered screen 42, reversible interim conveyors 43 and 51, cross conveyors 44, 48 and 52, and the screen outfeed conveyor 56.

As further shown in FIG. 2 by height restriction plane 57, in its operational configuration, the height of the mobile screen unit 18 exceeds the road height restriction of approximately 14 feet. As shown in FIG. 2A, to allow the mobile screen unit to be moved via the public road system, the screen outfeed conveyor 56 of the preferred embodiment is hinged at 53 such that it can fold back on itself. Also, the screen outfeed conveyor can be raised and lowered to allow the folded outfeed conveyor 56 to fit within the height restriction plane 57, as shown in FIG. 2A. In the illustrated embodiment, hydraulic cylinders 55, when actuated, cause the upper portion of the screen outfeed conveyor to fold back on itself to enable the mobile screen unit 18 to fit under the height road restrictions and to be hauled on the roads.

Figure 3A:
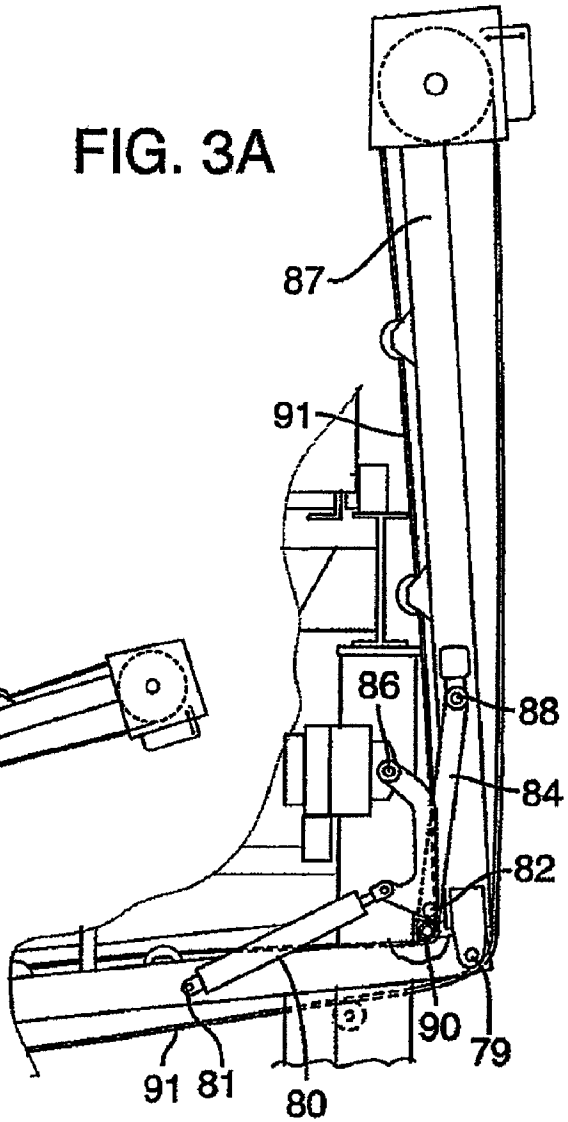
FIG. 3A is an expanded view of the folding cross conveyor of FIG. 3 depicting the conveyor belt tensioning mechanism in accordance with embodiments of the present invention.
Figure 3:
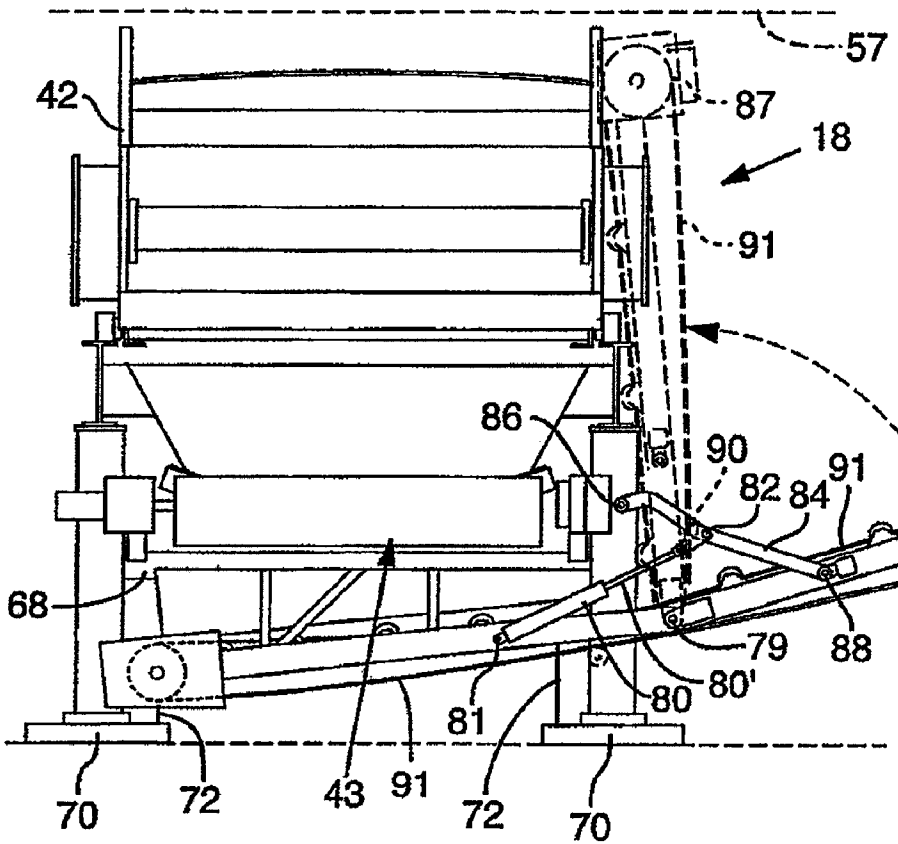
FIG. 3 is a rear view of the mobile screen unit illustrating the laterally protruding foldable cross conveyors in accordance with embodiments of the present invention.

Referring back to the mobile screen unit 18 depicted in FIG. 1, when in the operational configuration the cross conveyors 44, 48 and 52 extend laterally out the side of the screen unit so that they can transport the screened material to the respective telescoping stockpile conveyors 46, 50, and 54. To move the mobile screen unit 18 to a new location, the outer portions of the cross conveyors raise to a generally vertical position. As depicted in FIG. 3, the cross conveyors are hinged at hinge 79 to allow them to be folded upward in substantially a vertical position.

As seen in FIG. 3, to raise the portion of the conveyor that protrudes from the side of the transport trailer 68, the preferred embodiment uses hydraulic cylinders 80 that are mounted to both sides of the cross conveyor (only one side shown in FIGS. 3 and 3A) which is fixed under the transport trailer 68, at point 81. The actuating arm of each hydraulic cylinder 80 is attached to the pivot joint 82 of a connecting brace 84. The jointed connecting brace 84 connects the protruding portion 87 of the cross conveyor 44, 48, 52 to the side of the transport trailer at 86 at a point higher in relation to the pivot joint 82. The other end of the jointed connecting brace 84 is attached to the outer section 87 of the folding conveyor at point 88. When the cylinder 80 is actuated, actuator arm 80' pulls inward and downward on pivot joint 82, which causes the outer section 87 of the cross conveyor to rise to the generally vertical transport position (as depicted in FIG. 3A and in FIG. 3 by dashed lines) such that the height of the vertical conveyor portion 87 does not exceed height restriction plane 57.

When raising the cross conveyors 44, 48 and 52 to the transport position, the conveyor belt 91 tends to slacken and slip over the end of the conveyor such that it will drag on the ground when in transport. To prevent the conveyor belt slackening and dragging on the ground when folded in the upright position, a belt tensioner is used that keeps tension on the belt as the conveyor is raised. In the preferred embodiment, and as shown in FIG. 3A, a cross member 90 is attached between the connecting braces 84 (at each side of the conveyor) and positioned such that as the conveyor folds and the belt begins to rise up due to slippage over the conveyor end, the cross member 90 contacts the conveyor belt 91. As the conveyor continues to rise, the cross member keeps tension on the belt and prevents slackening by holding the belt close to the conveyor pivot point 79. Thus when the cross conveyor is raised to the vertical position, the belt remains tensioned around the entire length of the conveyor so when the mobile screen unit 18 is moved, the belt will not drag on the ground.

Figure 4:
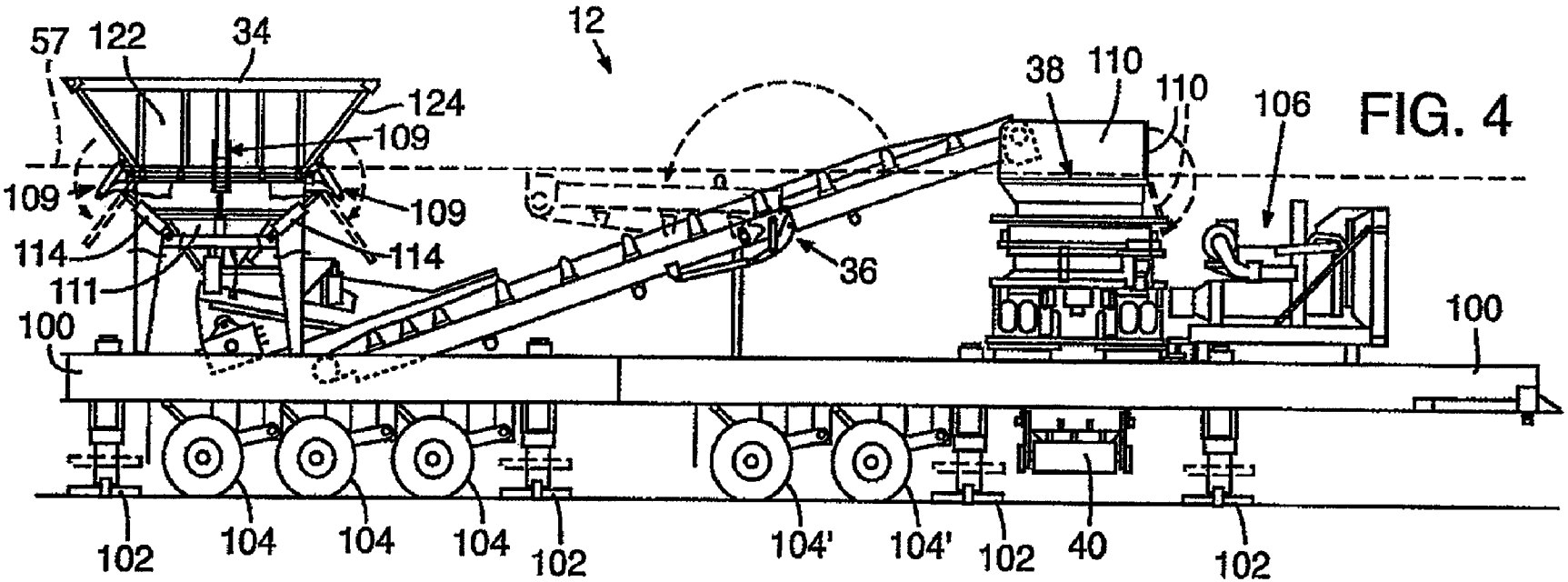
FIG. 4 is a sectional view of the mobile cone crusher unit illustrating the surge bin with the foldable sides in the operational position and dashed lines illustrating the transportable position in accordance with embodiments of the present invention.

FIG. 4 depicts mobile cone crushing unit 12. It is to be understood that in the preferred embodiment of the present invention, the mobile cone crushing unit 14 is the same as mobile cone crushing unit 12 and its features will not be separately discussed. In order to achieve complete modularization of a major component and allow full mobility, the mobile cone crushing unit 12 utilizes several of the same features as the mobile screen units 16 and 18, discussed above. The preferred embodiment of the mobile cone crushing unit 12 also consists of a mounting trailer 100, multiple stabilizing and leveling jacks 102, multiple axle and wheel combinations 104 and 104' to distribute weight, steerable axle and wheel combinations 104' that compensate for trailer length, and a self contained power generation unit 106 that operates the surge bin 34, cone crusher feed conveyor 36, cone crusher 38, and the cone crusher cross conveyor 40.

The preferred embodiment of the cone crusher feed conveyor 36 is hinged in the same manner as the outfeed conveyor 56 for the mobile screen unit 18, which is shown in FIGS. 2 and 2A and discussed above. As further shown in FIG. 4, to put the mobile cone crushing unit into transport configuration, the cone crusher feed conveyor 36 folds back on itself such that it falls below the height restriction plane 57. The cone crusher cross conveyor 40 is also hinged such that the protruding portion rises to the vertical position in the same manner as the mobile screen unit cross conveyors as depicted in FIG. 3. Folding the cone crusher cross conveyor to the vertical position enables the mobile cone crushing unit to be transported on public roads. The same conveyor tensioning mechanism 90 is used to prevent slackening of the conveyor belt when it is folded vertically as that used for the mobile screen unit 18 cross conveyor shown in FIG. 3A.

The mobile cone crushing unit 12 further consists of a cone crusher 38 that reduces rock to the desired size and deposits it onto the cross conveyor 40. To meet road height requirements, the cone crusher receiving chamber has hinged walls 110 that allow the sides to fold over for transport. The variable feed surge bin 34 receives rock from a mobile screen unit 16 or 18 (as shown and discussed in regards to FIG. 1) and feeds a steady stream of material to the cone crusher feed conveyor 36, which in turn conveys the material to the cone crusher 38 for processing. Because the amount of rock that needs further crushing after passing through a mobile screen unit is variable, the surge bin 34 has higher sides that allows sufficient quantities of rock to be amassed. This allows the surge bin 34 to provide the controlled constant feed of material to the cone crusher 38, which ensures reliable and efficient operation.

Figure 5:
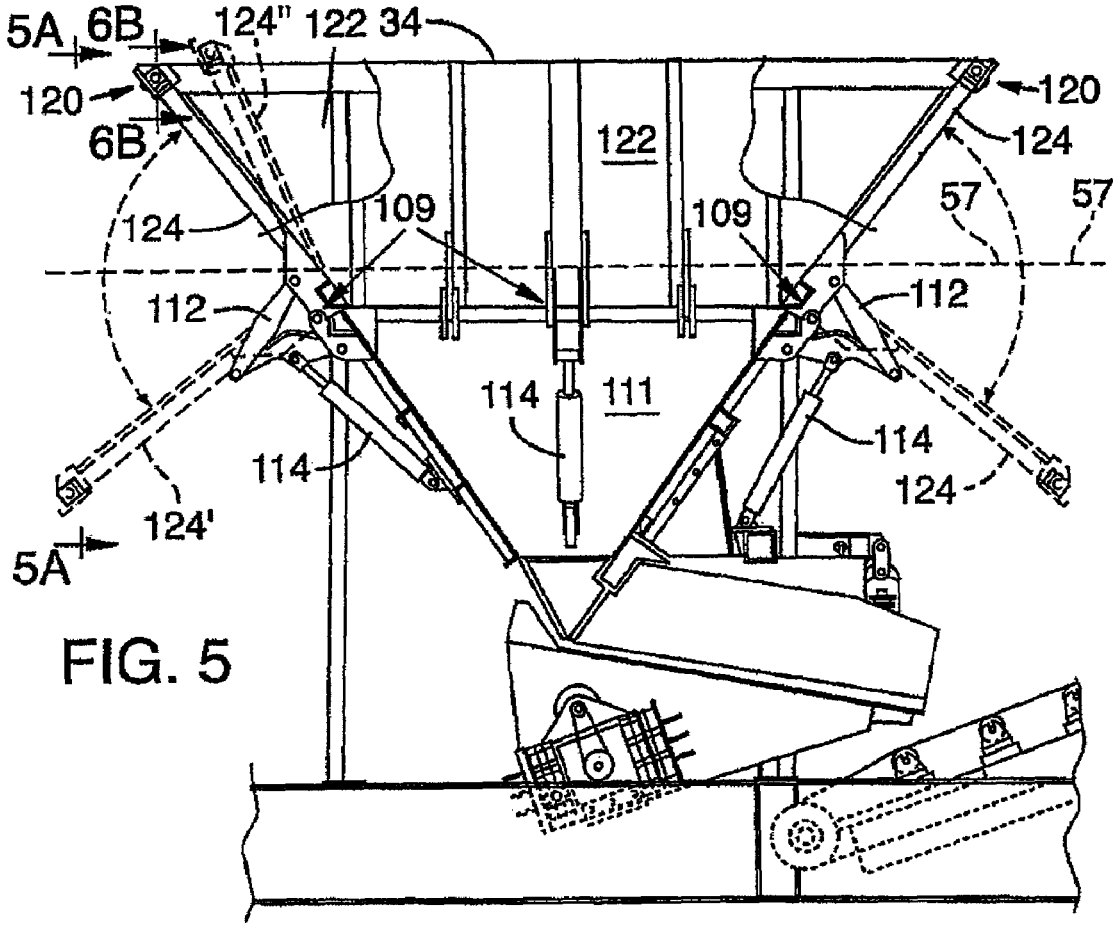
FIG. 5 is an enlarged side view of the surge bin of FIG. 4.
Figure 5A:
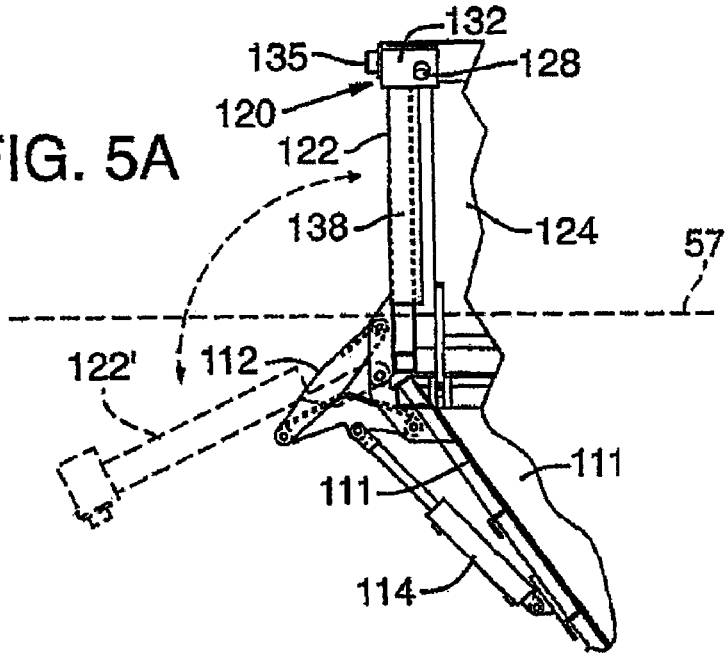
FIG. 5A is an enlarged view of the surge bin wall folding mechanism in accordance with embodiments of the present invention.
Figure 6A:
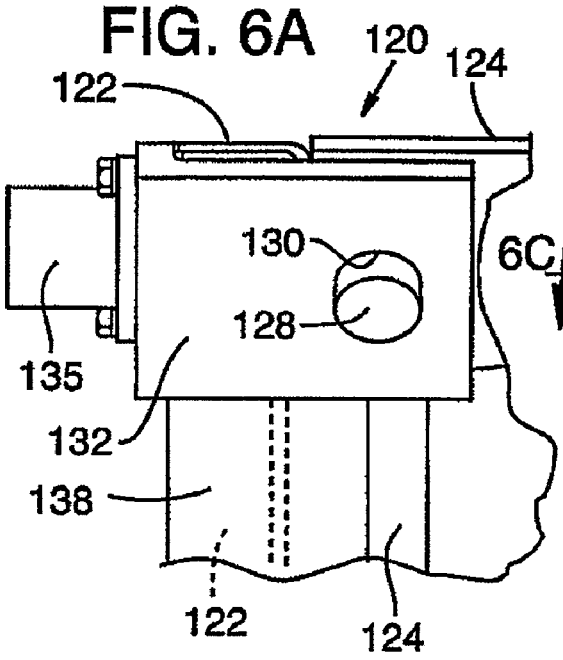
FIGS. 6A-6C are various views of the locking mechanism that prevents the surge bin walls from failing while in operation and that enables folding of the walls for transport of the rock crusher in accordance with embodiments of the present invention.
Figure 6B:
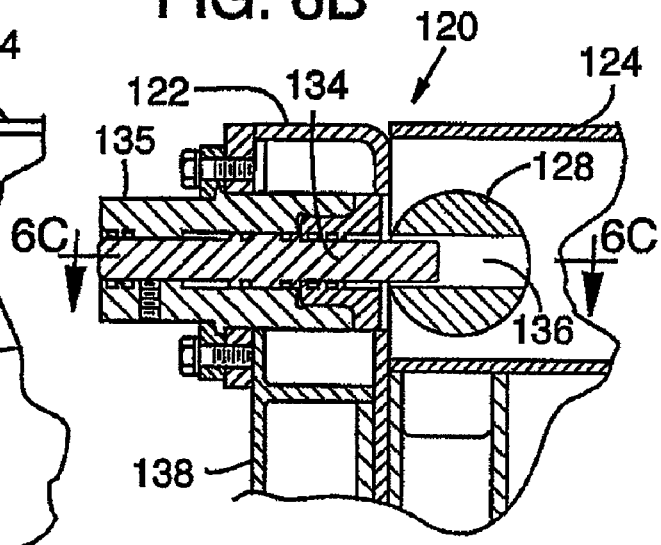
Figure 6C:
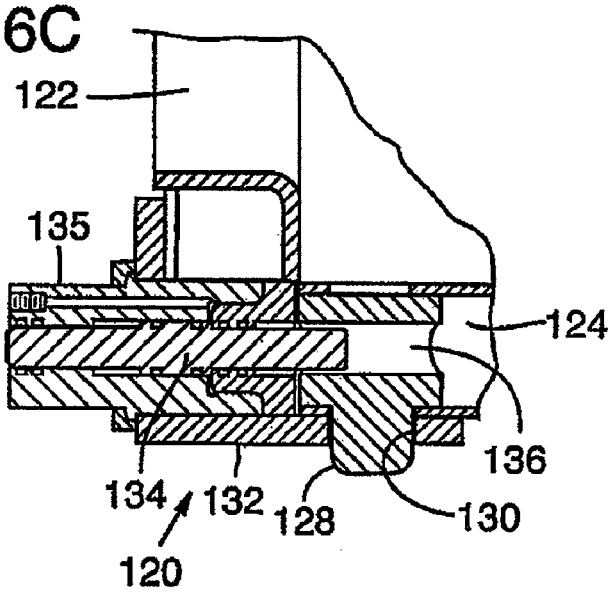

As shown in FIG. 4, the high sides of the surge bin 34 also cause the mobile cone crusher unit 12 to exceed the road height requirements depicted by height restriction plane 57 while in the operational position. As to enable mobility of the mobile cone crushing unit 12, the side walls 122 and end walls 124 of the surge bin 34 are hinged at hinge 109 such that when disconnected from each other they can fold down. As further shown in FIGS. 5 and 5A, the preferred embodiment of the folding surge bin 34 consists of a hydraulic cylinder 114 connected to a hinge linkage 112, which connects the folding portion of end walls 124 and side walls 122 to the respective non-folding portion of the surge bin walls 111. To move the wall from the folded position to the operational position, the hydraulic cylindar 114 moves outward and upward controllably pushing the wall into position. In the preferred embodiment, each of the surge bin side walls 122 and end walls 124 possess a hydraulic cylinder 114 pivotally attached to both the hinge linkage 112 and the respective non-folding portion of the surge bin wall 111.

When in operation, a substantial amount of rock can collect in the surge bin 34. This exerts tremendous outward forces on the folding surge bin walls 111. To enable the folding surge bin walls 122,124 to withstand these outward forces, the end walls 124 are securely attached to the sidewalls 122 at each corner 120 and supported along much of the length of the wall to a point above hinge point 109. This connection cannot be permanent, e.g. in the form of a weld, otherwise it could not be readily disconnected to prepare the cone crushing unit 12 for moving and reconnected when in its new location. Yet, the connection must be strong enough such that the surge bin walls can withstand the extreme outward forces encountered as the surge bin 34 fills with rock.

In one embodiment in accordance with the present invention, one or more individual mobile processing units may be in control communication with a central control unit for monitoring and controlling the operations of the mobile processing units. The mobile processing units may include, but are not limited to, a mobile screen unit configured to size separate aggregate material, a mobile rock crushing unit adapted to size reduce aggregate material, and one or more conveyers configured to transport material to discrete locations (e.g. from one mobile unit to another, and/or to a stockpile location). The mobile processing units may be, for example, similar to those described above with respect to various embodiments of the present invention.

As current rock processing systems typically require hard wired communications and control among the processing units, as well as, require power cables to be run from a central source, several problems can arise that can result in significant downtime and that interrupts operation.

For example, due to the harshness of the environment and the extreme vibration and other forces encountered by the individual processing units, the communication cables may disconnect, open or generally fail requiring the entire plant to be shut down while operators troubleshoot and fix the problem. Furthermore, because a variety of heavy equipment, such as front end loaders, earth movers, dump trucks and the like may operate around the mobile plant, the potential exist for the communication lines to further be subjected to forces that may result in breakage and/or disconnection. Finally, the break down and set up time of the mobile processing plant may be prolonged by the need to run communication cables to the various mobile processing units. Accordingly, embodiments of the present invention include a mobile central control unit adapted to monitor and/or control the mobile units via a wireless network.

Figure 7:
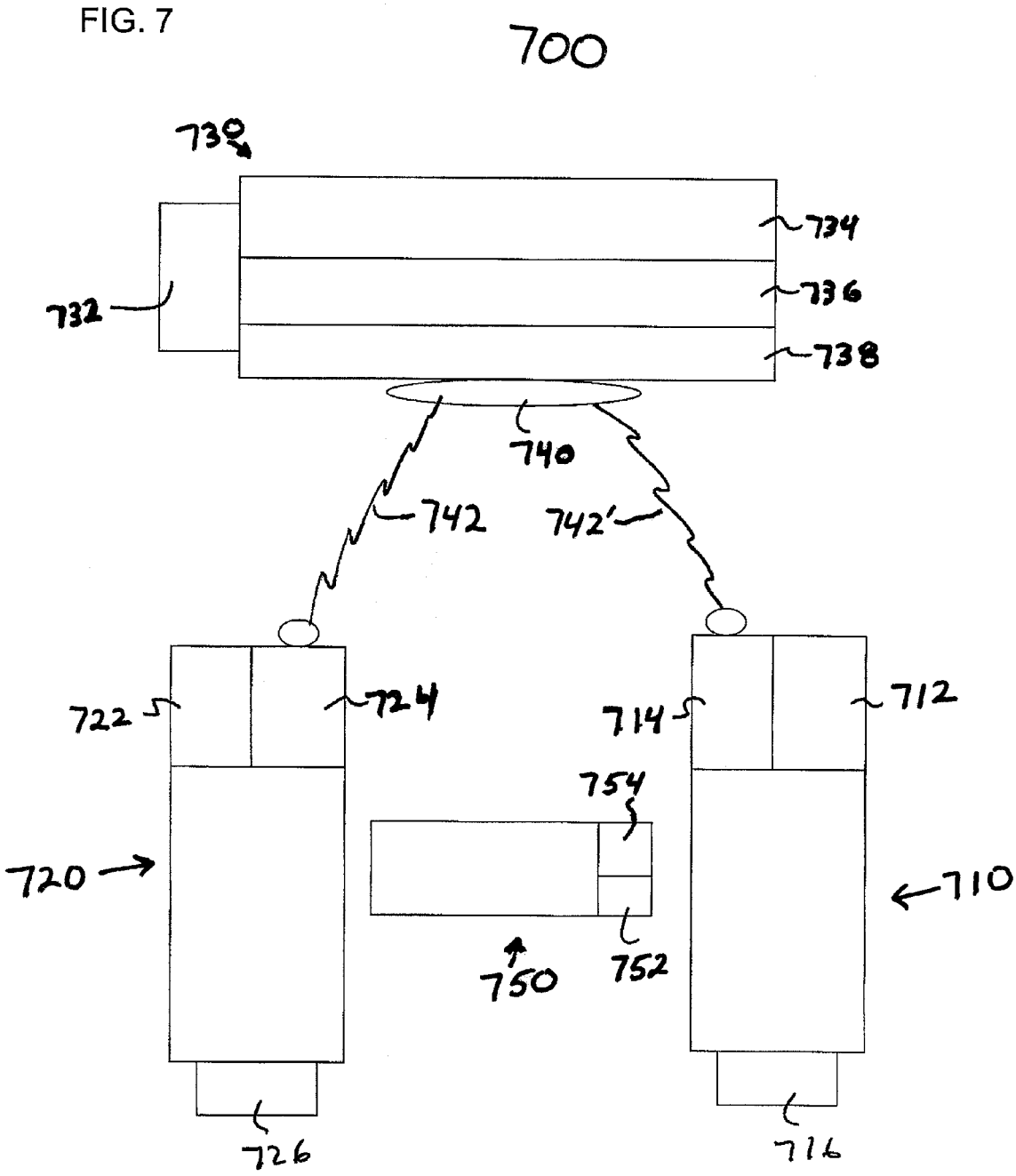
FIG. 7 is plan view of a mobile rock crushing plant in accordance with embodiments of the present invention.

FIG. 7 illustrates a block diagram of a mobile processing plant in accordance with embodiments of the present invention. Mobile processing plant 700 may include one or more mobile processing units. In one embodiment, mobile processing plant 700 may include one or more mobile crushing units 710 and one or more mobile screen units 720. Fewer or more mobile screen and/or crushing units may be used depending on the consistency of the incoming material and desired product after processing. An example of one configuration of mobile processing units in accordance with various embodiments may include one similar to that as illustrated with respect to FIG. 1. Yet in various other embodiments, other types of crushers, screens and/or other processing devices may be used. Further, the processing units may be coupled to movable bases such that they can perform processing operations while so coupled. In various other embodiments, the processing units may be adapted to be loaded onto and/or coupled to a mobile base for transport purposes, but not for processing purposes.

The mobile processing units may be configured to operate on a system communication protocol, such as Profinet, Ethernet, Devicenet, and the like, as the communications platform for controlling the operating parameters of the individual processing units. As used herein, operating parameters may include, but are not limited to, the various signal inputs, signal outputs and controls of the sub-components of the mobile processing units (e.g. power plants, motors, feed devices, cross conveyors, etc.) to perform the function of processing aggregate material. Such operating parameters may include, but are not limited to monitoring and/or controlling operating speeds, temperatures, positions, pressures, feed rates, etc., of the various sub-components.

In various embodiments, a central control unit 730 may be positioned proximate to (e.g. within the vicinity of and/or the same job site) the mobile processing units 710 and 720 in such a way that one or more operators may control the integration and operation of the overall mobile processing plant 700, by monitoring and/or controlling the operations of the individual mobile plants, as well as, in some embodiments, various processing conveyors. Central control unit 730 may also include an independent power source 732, such a diesel driven generator, or may be adapted for electrical coupling to an AC or DC power supply. In various embodiments, a separate central power source may be provided to run any one or all of the mobile processing units and/or the central control unit.

Central control unit 730 may further include a programmable logic controller 734 (PLC) or other master control device adapted to monitor and control the operation of the mobile processing units, including, but not limited to monitoring and/or controlling the operating parameters of the mobile screen unit 720 and mobile crushing unit 710. PLC 734 may be configured to communicate with and control the mobile processing units via the system communication protocol. In various embodiments, PLC 734 may be coupled to a system bus 736, which is compatible with mobile unit busses 712 and 722 of the individual mobile processing plants 710 and 720.

The system bus 736 may be further coupled to a transceiver 738, adapted to transmit and/or receive signals wirelessly to and from the mobile processing units. Transceiver 738 may be coupled to an antenna 740 and adapted to convert control signals to and from, for example, radio frequency (RF) signals 742 and 742' and transmit such signals via the wireless network. The transceiver may include a variety of active and passive components such as an amplifier, filter, mixer, oscillator and the like. In one embodiment, such components may be part of an integrated circuit and include a number of discrete components such as diodes, transistors, resistors, capacitors and the like.

As used herein, transceiver is broadly used to describe a device or devices that may be adapted to receive and/or convert electrical signals to and from RF signals or other wireless signals. In various embodiments a separate transmitter and receiver may comprise a transceiver, or they may be integrated in a common unit. In various embodiments, signals may be sent wirelessly via optical, infrared, or other non-hardwired means.

Mobile crushing unit 710 may also include a crusher transceiver 714, adapted to receive and transmit RF signals 742' to and from the central control unit 730. Likewise, mobile screen unit 720 may include a screen transceiver 724 adapted to receive and transmit RF signals 740 to and from the central control unit 730. Transceivers 714 and 724 may each be further coupled to a respective crusher system bus 712 and screen system bus 722. Busses 712 and 722 may be coupled to the various sub-components 716 and 726 of the mobile crushing unit 710 and mobile screen unit 720, respectively, and adapted to communicate monitor and control signals between the sub-components and the transceivers.

The wireless communication between the central control unit and the mobile processing units may be based on a number of wireless network standards. In one embodiment, the wireless communication protocol may be compliant with the Institute of Electrical and Electronic Engineers (IEEE) 802.11 specifications. In selecting a wireless network specification, a number of factors may be considered, such as range, power rates, data transfer rates, path loss, access points, etc. In one embodiment of the present invention, the IEEE 802.11 b and IEEE 802.11g standards may be used as the wireless network protocol.

In various embodiments, central control unit 730 may also be in wireless communication with one or more processing conveyors 750. Such processing conveyors may include, but are not limited to feed conveyor, stockpile conveyors, cross conveyors and alike. Processing conveyor 750 may include a transceiver 754 coupled to the conveyor bus 752, which may in turn be adapted to transmit the monitoring and control signals to control the operating parameters of the conveyor sub-components, such as the conveyor motor. In various embodiments, the process conveyors may be in communication a particular mobile processing unit as one of the sub-components that is coupled to the system bust and controllable there through from the central control unit.

Figure 8:
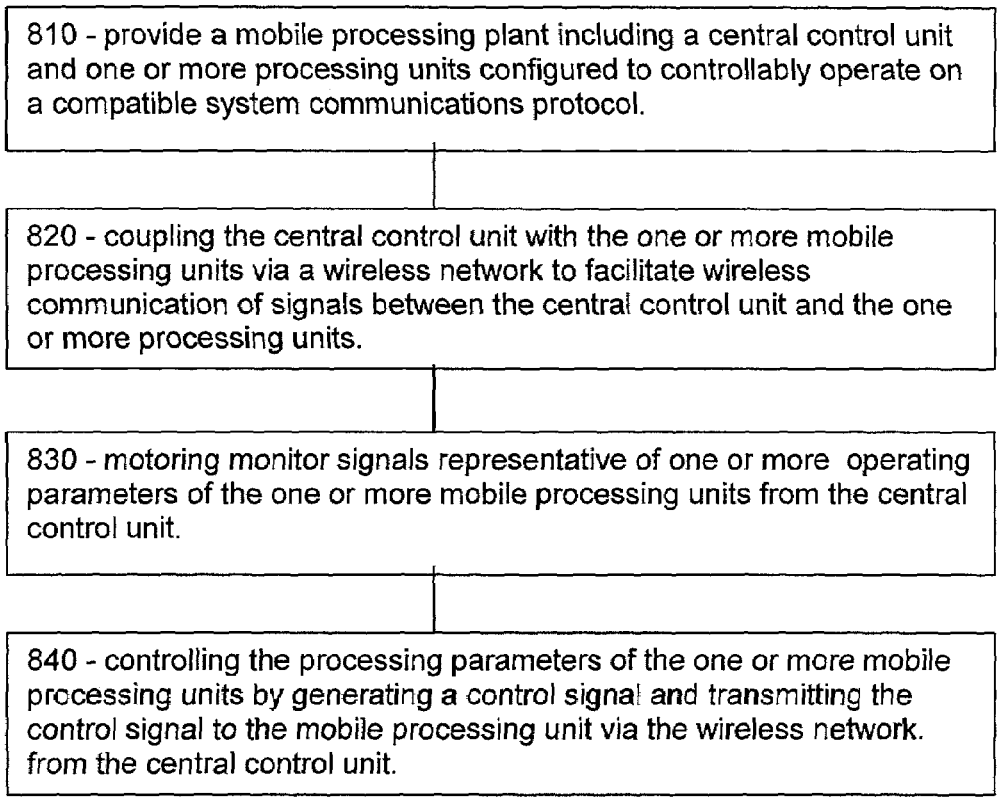
FIG. 8 illustrates a method of wirelessly controlling a mobile rock crushing plant in accordance with embodiments of the present invention.

FIG. 8 illustrates a method of wirelessly monitoring and controlling multiple mobile rock processing units from a central control unit in accordance with embodiments of the present invention. A central control unit and one or more rock processing units may be provided which are configured to controllably operate on a compatible communications protocol, such as Profinet (810). The central control unit and the one or more mobile processing units may be in wireless communication through a wireless network in order to facilitate monitoring and/or control of the one or more mobile processing units from the central control unit (820).

The central control unit may monitor certain processing perimeters of the one or more mobile rock processing units by receiving wireless monitoring signals transmitted by the mobile processing units representative of the certain operating parameters (830). Such monitoring signals may include information/data on operating speeds, temperatures, pressures, material status, etc. The central control unit may then variably control the various operating parameters of the mobile processing plants by wirelessly transmitting a control signal to the mobile processing unit with a signal representative of a different operating parameter setting, if required (840).

For example, if the mobile processing unit was a mobile crushing unit, such as a cone crusher plant, operating at normal conditions, and one of the conditions being monitored is the cone plant engine load. If the load exceeds a certain level, such a condition may trigger an alarm. In various embodiments a visual and/or audible alarm may sound in the central control unit. Based on such a condition, may include adjusting the cone, adjusting the feed rate, etc. in order to decrease the engine load. In another example, level indicators may be used in order to prevent overflow of material to the plant. If the level condition gets outside a prescribed parameter, a signal may be sent and corrective action may be taken (e.g. stop the crusher, re-level, change the feed rate, etc.)

In various embodiments, based on certain conditions of a monitored parameter, the corrective action may be automatically generated and communicated with the mobile processing unit to the condition within a certain parameter.

Figure 9:
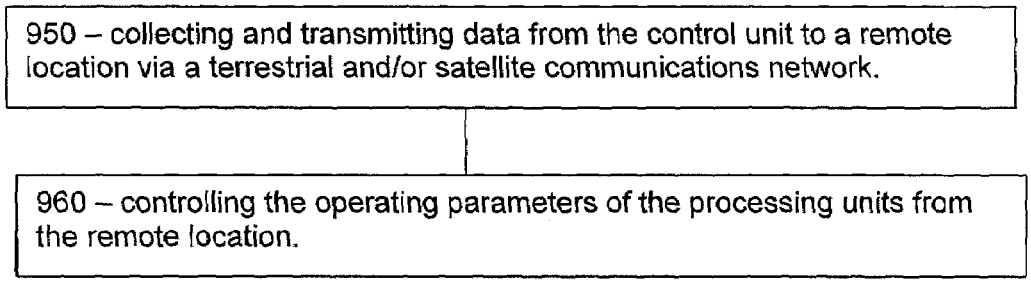
FIG. 9 illustrates a method of wirelessly communicating with a remote location in accordance with embodiments of the present invention.

In various embodiments, the central control unit may be configured to transmit to and receive data from a remote location via a terrestrial and/or satellite network (FIG. 9 for example). In such embodiments, a user may access data collected by the central control unit on the operating parameters of the various units (including sub-components) of a mobile processing plant 950. Such data may be periodically reviewed and/or analyzed such that potential problems and/or conditions with the units themselves and/or their sub-components may be detected and corrected prior to significant damage and/or failure conditions. Such corrections may be implemented from the remote location or locally based on the analyzed data, by sending control signals to the control unit to further control the operating parameters of the mobile processing units. Further, in various embodiments, the data may be used to track processing information, such as quantity and quality of processed material.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A mobile aggregate processing plant comprising:

multiple processing units cooperatively arranged to crush and size sort aggregate material, the multiple processing units being coupled together by conveyors adapted to help move aggregate material from one processing unit to another, wherein each of the multiple processing units are adapted to be efficiently decoupled from each other, transported over public roadways and recoupled at a second site, and wherein the multiple processing units are each mounted on a movable base, and include a releasable stabilizing mechanism for selectively stabilizing the processing units and controllably rendering them immobile and mobile as desired; and a mobile control unit wirelessly coupled to and in communication with one or more of the multiple processing units, the control unit adapted to monitor and/or control the multiple processing units.

2. The mobile aggregate processing plant of claim 1, wherein one or more of the multiple mobile processing units include one or more sub-components which have operating parameters to be monitored and/or controlled by the control unit.

3. The mobile aggregate processing plant of claim 1, wherein the multiple processing units include a primary crushing unit a screen unit and a secondary crushing unit cooperatively arranged to crush and size sort aggregate material.

4. The mobile aggregate processing plant of claim 1, wherein the mobile control unit includes wireless transmission components, wherein the wireless transmission components are configured to transmits data to a remote location via a satellite and/or a terrestrial based wireless communication network.

* * * * *